US008362926B2

(12) United States Patent
Kim et al.

(10) Patent No.: US 8,362,926 B2
(45) Date of Patent: Jan. 29, 2013

(54) METHOD AND APPARATUS FOR PROVIDING AND USING PUBLIC TRANSPORTATION INFORMATION

(75) Inventors: Young In Kim, Seoul (KR); Ho Taek Hong, Seoul (KR); Joo Heoun Seo, Osan-si (KR)

(73) Assignee: LG Electronics Inc., Seoul (KR)

( * ) Notice: Subject to any disclaimer, the term of this patent is extended or adjusted under 35 U.S.C. 154(b) by 361 days.

(21) Appl. No.: 12/527,902

(22) PCT Filed: Jul. 31, 2007

(86) PCT No.: PCT/KR2007/003677

§ 371 (c)(1),
(2), (4) Date: Jan. 21, 2010

(87) PCT Pub. No.: WO2008/102936

PCT Pub. Date: Aug. 28, 2008

(65) Prior Publication Data

US 2010/0134324 A1 Jun. 3, 2010

Related U.S. Application Data

(60) Provisional application No. 60/891,107, filed on Feb. 22, 2007.

(30) Foreign Application Priority Data

Apr. 25, 2007 (KR) ..... 10-2007-0040267

(51) Int. Cl.
*G08G 1/123* (2006.01)

(52) U.S. Cl. ..... 340/994; 340/539.2; 340/988; 701/117; 701/400

(58) Field of Classification Search ..... 340/994, 340/988, 995.19, 539.2; 701/400, 300, 117
See application file for complete search history.

(56) References Cited

U.S. PATENT DOCUMENTS

| | | | | |
|---|---|---|---|---|
| 5,131,020 | A | 7/1992 | Liebesny et al. | |
| 5,751,245 | A * | 5/1998 | Janky et al. | 340/994 |
| 6,006,159 | A * | 12/1999 | Schmier et al. | 340/994 |
| 6,952,645 | B1 * | 10/2005 | Jones | 340/994 |
| 2002/0099500 | A1 * | 7/2002 | Schmier et al. | 340/994 |
| 2003/0033077 | A1 * | 2/2003 | Watanabe | 701/117 |

(Continued)

FOREIGN PATENT DOCUMENTS

| | | | |
|---|---|---|---|
| FR | 2873481 | A1 | 1/2006 |
| KR | 10-2001-0036842 | | 5/2001 |

(Continued)

OTHER PUBLICATIONS

International Search Report and Written Opinion for Application No. PCT/KR2007/003677 dated Nov. 21, 2007, 8 pages.

(Continued)

*Primary Examiner* — Eric M Blount
(74) *Attorney, Agent, or Firm* — Fish & Richardson P.C.

(57) ABSTRACT

The present invention relates to method and apparatus for providing and using transportation information of various types of public vehicles. A public transportation information encoding method according to the present invention creates identifying information on a type of public transportation means and on stations pertaining to service line of the public transportation means, and further creates connection information for particular stations among the stations wherein citizens are able to use the same or different type of public transportation means on other stations near to the particular stations. The created information including the connection information is organized to status information which is then incorporated into a transfer message. Thusly constructed messages are transmitted wirelessly.

34 Claims, 18 Drawing Sheets

U.S. PATENT DOCUMENTS

| | | | | |
|---|---|---|---|---|
| 2004/0255297 | A1* | 12/2004 | Horstemeyer | 718/100 |
| 2009/0125218 | A1* | 5/2009 | Lee et al. | 701/117 |
| 2010/0318285 | A1* | 12/2010 | Kim et al. | 701/117 |

FOREIGN PATENT DOCUMENTS

| | | | |
|---|---|---|---|
| KR | 10-2002-0041171 | | 6/2002 |
| KR | 10-2004-0046606 | | 6/2004 |
| KR | 10-2006-0002468 | | 1/2006 |
| KR | 10-2007-0018653 | | 2/2007 |
| KR | 10-2007-0018653 | A | 2/2007 |
| KR | 10-2007-0018654 | | 2/2007 |
| WO | WO 00/46944 | A2 | 8/2000 |
| WO | WO 01/22633 | A2 | 3/2001 |
| WO | WO 2007/018353 | | 2/2007 |
| WO | WO 2007/018354 | | 2/2007 |

OTHER PUBLICATIONS

Chinese Office Action dated Apr. 21, 2011 for Application No. 200780051720.9, with English translation, 11 pages.

European Search Report dated Mar. 10, 2011 for Application No. EP07793332, 4 pages.

* cited by examiner

FIG. 3

```
<mti_message>:=
<intunli>(mid),                          : Message ID
<intunli>(ver),                          : Version Number
<intunli>                                : Length, n, of component data in bytes
<bitswitch>(selector),                   : Message elements supplied
if(selector = xxxxxxx1) <time_t>,        : Message generation time
if(selector = xxxxxx1x) <intunlo>,       : Reserved for future use
if(selector = xxxxx1xx) <intunlo>,       : Reserved for future use
if(selector = xxxx1xxx) <intunlo>,       : Reserved for future use
if(selector = xxx1xxxx) <intunlo>,       : Reserved for future use
if(selector = xx1xxxxx) <intunlo>,       : Reserved for future use
if(selector = x1xxxxxx) <intunlo>,       : Reserved for future use
if(selector = 1xxxxxxx) <mti_components>: public transportation information
                                          message components
```

303

301

302

FIG. 4

```
<mti_components >:=
<intunti>(n),                  : Number of components
n*<mti_component()>;           : public transportation information message component
```

```
<mti_component(x) >:=: Public Transportation Information template
<intunti>(id),          : Identifier, id=x hex
<intunli>(n),           : Length, n, of component data in bytes
n*<byte>;               : Component data
```

FIG. 6A

```
<mti_component(80) >:=      : Route information using station sequential number
<intunti>(id),              : Identifier, id=80 hex
<intunli>(n),               : Length, n, of component data in bytes
<mti01>,                    : ID of transporation type ( bus, subway, etc. )
<mti02>,                    : type of public transportation ID system
<intunlo>,                  :  Route service number
<intunti>(m)                :  the number of transportation means in service
m*<route_information_using_stop_sequential_number>;:route information element
```

601

```
<route_information_using_station_sequential_number>:= current location
<intunti>;                  : Sequential number of station
```

601a

```
<route_information_using_station_sequential_number>:= current location
<intunti>,                  : Sequential number of station
<intunli>;                  : predicted arrival time to the next station (in sec.)
```

FIG. 6B

```
<mti_component(81) >:=      : Route information using station identifier
<intunti>(id),              : Identifier, id=81 hex
<intunli>(n),               : Length, n, of component data in bytes
<mti01>,                    : ID of transporation type ( bus, subway, etc. )
<mti02>,                    : type of public transportation ID system
<intunlo>,                  :  Route service number
<intunti>(m)                : the number of transportation means in service
m*<route_information_using_station_id>;:route information  element
```

602

```
<route_information_using_station_id>:=current location
<intunlo>;                  : station ID
```

602a

```
<route_information_using_station_id>:= current location
<intunlo>;                  : station ID
<intunli>;                  : predicted arrival time to the next station (in sec.)
```

FIG. 6C

```
<mti_component(82) >:=     : Route information using section identifier
<intunti>(id),             : Identifier, id=82 hex
<intunli>(n),              : Length, n, of component data in bytes
<mti01>,                   : ID of transporation type ( bus, subway, etc. )
<mti02>,                   : type of public transportation ID system
<intunlo>,                 : Route service number
<intunti>(m)               : the number of transportation means in service
m*<route_information_using_section_id>;:route information element
```

603

```
<route_information_using_section_id>:= current location
<intunlo>;                 : section ID
```

603a

```
<route_information_using_section_id>:= current location
<intunlo>;                 : section ID
<intunli>;                 : predicted arrival time to the next station (in sec.)
```

FIG. 6D

```
<mti_component(83) >:=     : Route information using section of
                                          station sequential numbers
<intunti>(id),             : Identifier, id=83 hex
<intunli>(n),              : Length, n, of component data in bytes
<mti01>,                   : ID of transporation type ( bus, subway, etc. )
<mti02>,                   : type of public transportation ID system
<intunlo>,                 : Route service number
<intunti>(m)               : the number of transportation means in service
m*<route_information_using_section_of_station_sequential_number>;
```

604

```
<route_information_using_section_of_station_sequential_number>:=
                                                  current location
<intunti>,        : sequential no. of start station
<intunti>;        : sequential no. of end station
```

604a

```
<route_information_using_section_of_station_sequential_number>:=
                                                  current location
<intunti>,        : sequential no. of start station
<intunti>;        : sequential no. of end station
<intunli>;        : predicted arrival time to the next station (in sec.)
```

FIG. 6E

```
<mti_component(84) >:=      : Route information using section of station identifiers
<intunti>(id),              : Identifier, id=84 hex
<intunli>(n),               : Length, n, of component data in bytes
<mti01>,                    : ID of transporation type ( bus, subway, etc. )
<mti02>,                    : type of public transportation ID system
<intunlo>,                  : Route service number
<intunti>(m)                : the number of transportation means in service
m*<route_information_using_section_of_stop_id>;;route information element
```

605

```
<route_information_using_section_of_station_id>:= current location
<intunlo>,      : ID of start station
<intunlo>;      : ID of end station
```

605a

```
<route_information_using_section_of_station_id>:= current location
<intunlo>,      : ID of start station
<intunlo>;      : ID of end station
<intunli>;      : predicted arrival time to the next station (in sec.)
```

FIG. 6F

```
< mti_component(85) >:=        : Travel time of sections on a service route
<intunti>(id),                 : identifier, id=85 hex
<intunli>(n),                  : Length, n, of component data in bytes
<mti01>,                       : type of transporation ( bus, subway, etc. )
<mti02>,                       : type of public transportation ID system
<intunlo>,                     : Route service number
<intunti>(m),                  : the number of stations on a service route
m*<intunli>(travel_time);      : section travel time
                                 (in the order of stations)
```

FIG. 6G

```
<mti_component(86) >:=         : Route additional information
<intunti>(id),                 : identifier, id=86 hex
<intunli>(n),                  : Length, n, of component data in bytes
<mti01>,                       : ID of transporation type ( bus, subway, etc. )
<mti02>,                       : type of public transportation ID system
<intunlo>,                     : Route service number
<short_string>(service name),          : Route service name
m*<additional_service_information()>   : additional service information
```

FIG. 6H

| | |
|---|---|
| < mti_component(87) >:= | : List of stations constituting a service route |
| <intunti>(id), | : identifier, id=87 hex |
| <intunli>(n), | : Length, n, of component data in bytes |
| <mti01>, | : ID of transporation type ( bus, subway, etc. ) |
| <mti02>, | : type of public transportation ID system |
| <intunlo>, | : Route service number |
| <intunti>(m), | : the number of stations constituting a route (assumed to be no more than 255) |
| m*<intunlo>; | : IDs of stations constituting a route (the driving order of stations shall be kept) |

FIG. 7A mti01 Table

| identifiers of types of public transportation ID system | | |
|---|---|---|
| Code | Name | Example |
| 0 | Bus | inter-city, main line, branch line, shuttle, circulation, etc. |
| 1 | Subway | Underground train, electric train |
| 2 | Tram | street car |
| 3 | Etc | downtown transportation means (e.g., city sightseeing bus, sightseeing boat) |
| - - - | End of version 0.9 | |
| 255 | | |

FIG. 7B mti02 Table

| Public transportation ID system identifier | | |
|---|---|---|
| code | type | description |
| 0 | unknown | |
| 1 | KS public transportation ID system | Korea standard public transportation ID system |
| 2 | Seoul | local public transportation ID system of Seoul city |
| 3 | Anyang | local public transportation ID system of Anyang city |
| 4 | Bucheon | local public transportation ID system of Bucheon city |
| 5 | Goyang | local public transportation ID system of Goyang city |
| 6 | Kyonggi-Do | local public transportation ID system of Kyonggi-Do |
| 7 | Incheon | local public transportation ID system of Incheon city |
| 8 | Suweon | local public transportation ID system of Suweon city |
| 9 | Gwacheon | local public transportation ID system of Gwacheon city |
| 10 | Gunpo | local public transportation ID system of Gunpo city |
| 11 | Cheonan | local public transportation ID system of Cheonan city |
| 12 | Daejeon | local public transportation ID system of Daejeon city |
| 13 | Jeonju | local public transportation ID system of Jeonju city |
| 14 | Cheongju | local public transportation ID system of Cheongju city |
| 15 | Daegu | local public transportation ID system of Daegu city |
| 16 | Ulsan | local public transportation ID system of Ulsan city |
| 17 | Masan | local public transportation ID system of Masan city |
| 18 | Changwon | local public transportation ID system of Changwon city |
| 19 | Busan | local public transportation ID system of Busan city |
| 20 | Gimhae | local public transportation ID system of Gimhae city |
| 21 | Weonju | local public transportation ID system of Weonju city |
| 22 | Jeju | local public transportation ID system of Jeju city |
| - - - | End of version 0.9 | |
| 255 | | |

FIG. 9A

| | |
|---|---|
| <mti_component(88)> := | : Station information |
| <intunti>(id), | : identifier, id=88 hex |
| <intunli>(n), | : Length, n, of component data in bytes |
| <mti01>, | : ID of transporation type ( bus, subway, etc. ) |
| <mti02>, | : type of public transportation ID system |
| <intunli>(m), | : the number of stations. (expressed in a particular unit) |
| m*<station_information_unit>; | : Individual station information |

FIG. 9B

| | |
|---|---|
| <station_information_unit(00)>:= | :Individual station information element |
| <intunti>(id), | : identifier, id=00 hex |
| <intunli>(n), | : Length, n, of component data in bytes |
| <intunlo>, | : station ID |
| m*<station_descriptor_component()>;: | Station detail information component |

FIG. 9C

```
< station_descriptor_component(00) >:=: Information on transportation means
                                                    to arrive at each station
<intunti>(id),                  : Identifier, id=00 hex
<intunli>(n),                   : Length, n, of component data in bytes
<intunti>(m),                   : the number of transportation means to arrive next
m*<arrival_vehicle>;            : Transportation means to arrive

<arrival_vehicle>:=             : Information on transportation means to arrive
<intunlo>(route_id),                  : route identifier
<time_span>(predicted_travel_time),   : predicted travel time
<current_vehicle_position>;           : location of transportation means

                                 950a
<current_vehicle_position>:=    : Current location of transportation means
<bitswitch>(selector),                : location expressing method
if(selector=xxxxxxx1)
      <route_information_using_station_sequential_number>,
                                : see 601 of Fig. 6A
if(selector=xxxxxx1x)<route_information_using_station_id>,
                                : see 602 of Fig. 6B
if(selector=xxxxx1xx)<route_information_using_section_id>,
                                : see 603 of Fig. 6C
if(selector=xxxx1xxx)
      <route_information_using_section_of_station_sequential_number>,
                                : see 604 of Fig. 6D
if(selector=xxx1xxxx) <route_information_using_section_of_station_id>;
                                : see 605 of Fig. 6E
```

FIG. 9D

```
< station_descriptor_component(01) >:=     : Station detail information
<intunti>(id),                       : Identifier, id=01 hex
<intunli>(n),                        : Length, n, of component data in bytes
<short_string>(station_name),        : Station name
m*<additional_station_information()>;:Additional detail information component
```

FIG. 9E

```
< additional_station_information(00) >:=          : Station coordinates
<intunti>(id),                          : identifer, id=00 hex
<intunti>(n),                           : Length, n, of component data in bytes
<location_point_component(00)>:= : 5.3.1.2.4.2 WGS 84 of
                                          document ISO/TS 18234-6:2006(E)
```

FIG. 9F

```
< additional_station_information(01) >:=    : transfer guide information
<intunti>(id),                          : identifer,  id=01 hex
<intunti>(n),                           : Length, n, of component data in bytes
<long_string>;                          : information to guide transfer
```

FIG. 9G

```
< station_descriptor_component(02) >:=:Connection information on a transfer station
<intunti>(id),                  : Identifier, id=02 hex
<intunli>(n),                   : Length, n, of component data in bytes
<intunti>(m),                   :  the number of transferrable stations
m*<transfer_station>;           : Information on a transfer station
```

```
<transfer_station>:=            :  Transfer station
<intunti>(mti01_xx),            :  type of transportation means
<tpeg_loc>;                     : information for identifying a transfer station
```

| | |
|---|---|
| <bsi_component(89)> := | : Additional Information |
| <intunti>(id), | : identifier, id=89 hex |
| <intunli>(n), | : Length, n, of component data in bytes |
| <loc40>, | : Country code |
| <loc41>, | : Language code |
| <long_string>; | : Additional information |

FIG. 12A

| ID of Transportation type | route-based information table |
|---|---|
| 0 (bus) | bus route-based information table entry |
| 1 (subway) | subway line-based information table entry |
| 2 (tram) | tram line-based information table entry |
| 3 (etc) | etc route-based information table entry |
| | ⋮ |

| Route ID | Station ID | Station Seq. no. | Section travel time (min.) | Current location |
|---|---|---|---|---|
| B504 | Way-in Guro Industrial Complex | 1 | - | No (0) |
| B504 | Gasan Elementary School | 2 | 4 | Yes (1) |
| ⋮ | ⋮ | ⋮ | ⋮ | ⋮ |
| R9404 | Ori station | 1 | - | No (0) |
| R9404 | Miguem station | 2 | 3 | No (0) |
| R9404 | Korea Telecom | 3 | 5 | pre-sect (2) |
| ⋮ | ⋮ | ⋮ | ⋮ | ⋮ |

1201 1202

FIG. 12B

| ID of Transportation type | station-based information table |
|---|---|
| 0 (bus) | bus stop-based information table entry<br>transfer station information table entry |
| 1 (subway) | subway station-based information table entry<br>transfer station information table entry |
| 2 (tram) | tram station-based information table entry<br>transfer station information table entry |
| 3 (etc) | etc stop-based information table entry<br>transfer station information table entry |
| | ⋮ |

1210

| Bus Stop ID | Route (Line) ID | Sequential Stop ID | Predicted Arrival Time | Bus Location |
|---|---|---|---|---|
| 5-corners of Industrial Complex | B504 | 7 | 2:06PM | 0: 4-corners of Shinlim |
| 5-corners of Industrial Complex | G5528 | 10 | 1:51PM | 2: 5-corners of Industrial Complex - Gasan Elementary Sch. |
| ⋮ | ⋮ | ⋮ | ⋮ | ⋮ |
| Subway Station Gangnam | R9404 | 6 | 2:08PM | 3: Seohyeon St. - Sunae St. |
| Subway Station Gangnam | R9401 | 14 | 2:02PM | 4: Ori St. - Miguem Elementary School |
| ⋮ | ⋮ | ⋮ | ⋮ | ⋮ |

1211 1212

| Station ID | Transportation type | ID of Transfer Station | Transfer Guide Information |
|---|---|---|---|
| Express Bus Terminal | 1 (subway) | Line 2- Express Bus Terminal | "[Express bus] Kyungbu line, Honam line.... " [Subway] line 2, line 7....." |
| Express Bus Terminal | 1 (subway) | Line 7- Express Bus Terminal | "[Express bus] Kyungbu line, Honam line.... " [Subway] line 2, line 7....." |
| Gangnam | 1 (subway) | Line 2- Subway St. Gangnam | "[Subway] line 2 bound for Jamsil and Guro...." |
| ⋮ | ⋮ | ⋮ | ⋮ |

1215 1213 1214

FIG. 12C

| ID of Transportation type | public transportation information table |
|---|---|
| 0 (bus) | bus route-based information table entry |
| | bus stop-based information table entry |
| | transfer station information table entry |
| 1 (subway) | subway line-based information table entry |
| | subway station-based information table entry |
| | transfer station information table entry |
| 2 (tram) | tram line-based information table entry |
| | tram station-based information table entry |
| | transfer station information table entry |
| 3 (etc) | etc route-based information table entry |
| | etc stop-based information table entry |
| | transfer station information table entry |
| | ⋮ |

METHOD AND APPARATUS FOR PROVIDING AND USING PUBLIC TRANSPORTATION INFORMATION

1. TECHNICAL FIELD

The present invention is related to a method and apparatus for providing transportation information of public transportation means and using the provided information.

2. BACKGROUND ART

Due to recent advances in digital signal processing and communications technology, radio and TV broadcast signals are provided gradually in the form of digital data. As signals are provided in the form of digital data, a variety of information is now allowed to be added to TV or radio broadcast signals, the information including news, stock, weather, traffic, and so on.

Meanwhile, traffic congestion is commonly observed due to increase of the number of vehicles in downtown areas and the number of holiday vehicles during holidays. The increase of the number of vehicles accelerates environmental pollution; thus, using public transportation is highly recommended by government authorities. In order to have a citizen use public transportation on his or her own will, use of public transportation should also be more comfortable and service hours thereof should be predictable. For this purpose, public transportation means moving with private vehicles on the road such as a bus should provide service information and information about change of service hours due to road conditions. Also, necessary is providing information about connection among different types of public transportation means (e.g., between a bus and a subway train) and thus enabling the citizen to transfer among different types of public transportation means conveniently and quickly to facilitate public transportation usage. This is because in a big city, it is difficult to arrive at a destination by using public transportation means of a single kind alone.

Provision of public transportation information requires a standard format because a plurality of terminals made by different manufacturers should be able to detect broadcast digital transportation information and interpret the information in the same way for the user.

3. DISCLOSURE OF THE INVENTION

One objective of the present invention is to provide a method enabling the user to know current service conditions and availability of various types of public transportation means.

Another objective of the present invention is to enable an individual who has to use more than one type of public transportation means to easily choose ones for arriving at his or her destination and to estimate arrival time as well by providing transfer information for changing from a particular type of public transportation means to another.

One method for encoding public transportation information according to the present invention creates type information of public transportation means, service route identifying information of the type of public transportation means, and information about current locations of transportation means in service belonging to a service route identified by the service route identifying information, subsequently composing a component including the created information and incorporating the component into a message to be transmitted.

Another method for encoding public transportation information according to the present invention creates type information of public transportation means, identifying information about stations belonging to a service route of the type of public transportation means, and from among the stations, connection information for a station adjacent to other stations where the same or a different type of a transportation means is available, subsequently composing status information including the created information and incorporating the status information into a message to be transmitted.

One method for decoding public transportation information according to the present invention extracts status information from received signals and extracts from a component in the extracted status information type information of public transportation means, service route identifying information of a transportation means of the corresponding type, and information about current locations of transportation means in service belonging to a service route identified by the service route identifying information.

Another method for decoding public transportation information according to the present invention extracts status information from received signals and extracts from the extracted status information type information of public transportation means, identifying information about stations belonging to a service route of transportation means of the corresponding type, and for at least one station among the stations, connection information including information of other stations where the same or a different type of public transportation means is available.

In one embodiment according to the present invention, the information about a current location is information identifying a station or a section between stations where a transportation means is currently located.

In one embodiment according to the present invention, the information identifying a station is either a number assigned sequentially to each station belonging to an arbitrary route corresponding to the transportation type or an identifier assigned to each station for uniquely identifying the station from all the stations belonging to the transportation type within a service area of the public transportation information.

In one embodiment according to the present invention, the information identifying a section is either a pair consisting of an identifier assigned to each section for uniquely identifying a section from all the sections corresponding to the transportation type and a number assigned sequentially to each station belonging to an arbitrary route corresponding to the transportation type or a pair of identifiers, an identifier being assigned to each station for uniquely identifying the station from all the stations belonging to the transportation type within a service area of the public transportation information.

In one embodiment according to the present invention, the message to be transmitted includes an information system identifier for identifying a service information system of the transportation means.

In one embodiment according to the present invention, the connection information comprises an identifier for type of a transportation means that can be used at the other stations and information for identifying the other stations.

In one embodiment according to the present invention, the information for identifying the other stations includes an identifier assigned to each station for uniquely identifying the station from among all the stations belonging to a service route of transportation means belonging to type of a transportation means available at the other stations.

In another embodiment according to the present invention, the information for identifying the other stations comprises service route information of a transportation means available at the other stations and a number assigned sequentially to stations belonging to a service route identified by the service route information.

In one embodiment according to the present invention, transfer guide information is further created for a station where a different type of a transportation means can be used at a nearby place and provided together with the connection information.

In one embodiment according to the present invention, types of public transportation means are classified into a bus, a subway train, a tram, and miscellaneous downtown transportation means (e.g., a sightseeing bus, a sightseeing boat, and the like).

In one embodiment according to the present invention, for each individual station belonging to a service route of transportation means of a particular type, the number of transportation means to arrive at the station and as much information about transportation means to arrive as the number are created and provided.

In one embodiment according to the present invention, the information about a transportation means to arrive includes at least one from among a service route information of a transportation means to arrive, predicted arrival time of the transportation means, and current location information of the transportation means.

The present invention, the purpose and features of which are to be described in detail through the following embodiments, enables citizens who use various types of public transportation means to estimate time to wait for public transportation means available and at the same time, to know beforehand a transfer place to the same or a different type of a transportation means. Accordingly, citizens can do other things than wait for a transportation means to arrive, for example, buying some goods or having a coffee at a nearby café; besides, chances of making a mistake in using public transportation means to arrive at a destination become diminished. Also, through the increase of convenience in using public transportation means as above, citizens in a big city get to use public transportation means more frequently. Thus the number of private vehicles on the road can be reduced, eventually reducing economic and social cost due to road construction or environmental pollution.

4. BRIEF DESCRIPTION OF THE DRAWINGS

FIG. 3 illustrates syntax of a message management container according to the message structure of FIG. 2;

FIG. 4 illustrates syntax of a component constituting an application status container according to the message structure of FIG. 2;

Figure 5:
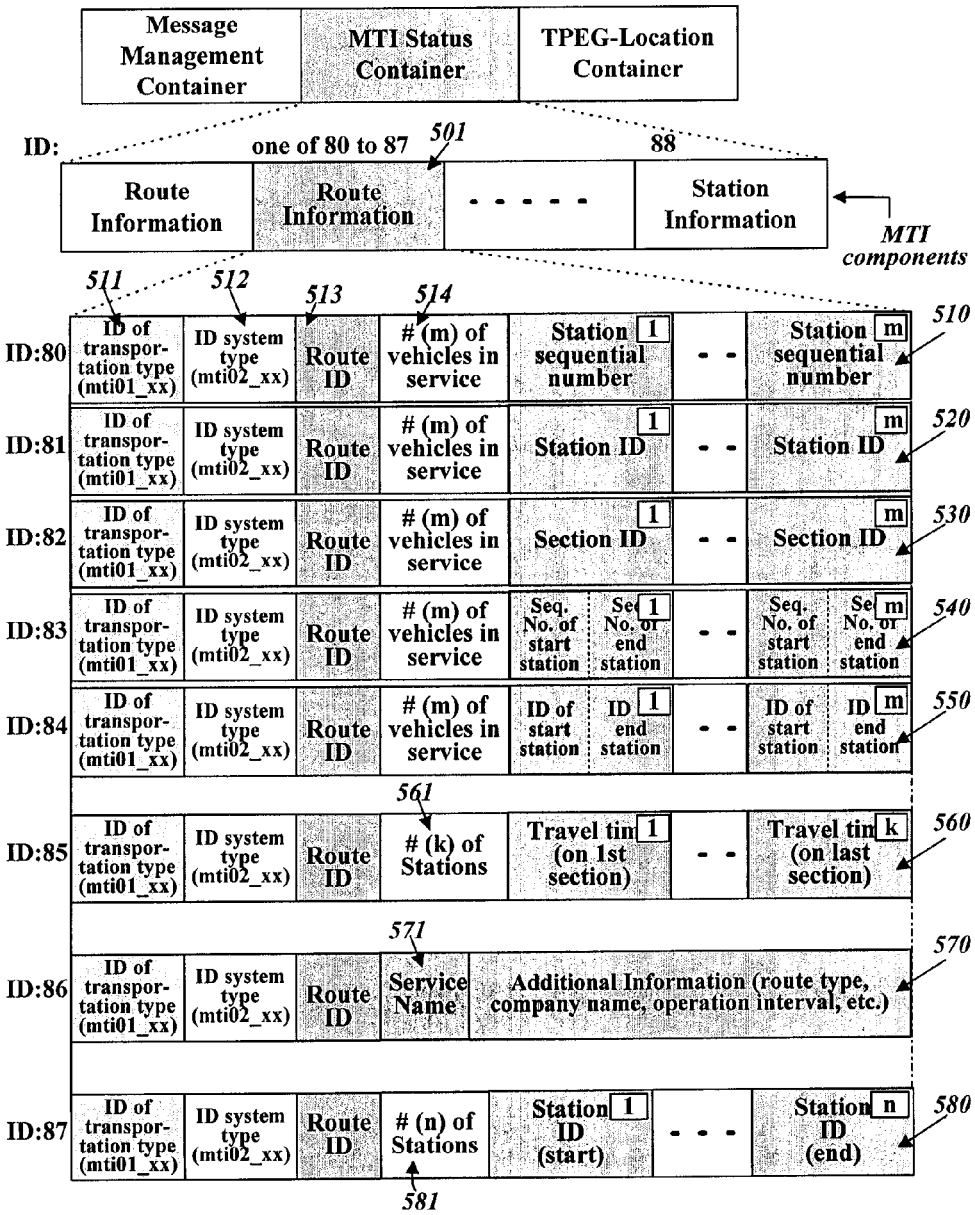
FIG. 5 illustrates the transfer format of TPEG message of public transportation information organized according to one embodiment of the present invention with regard to an application status container.
Figure 8:
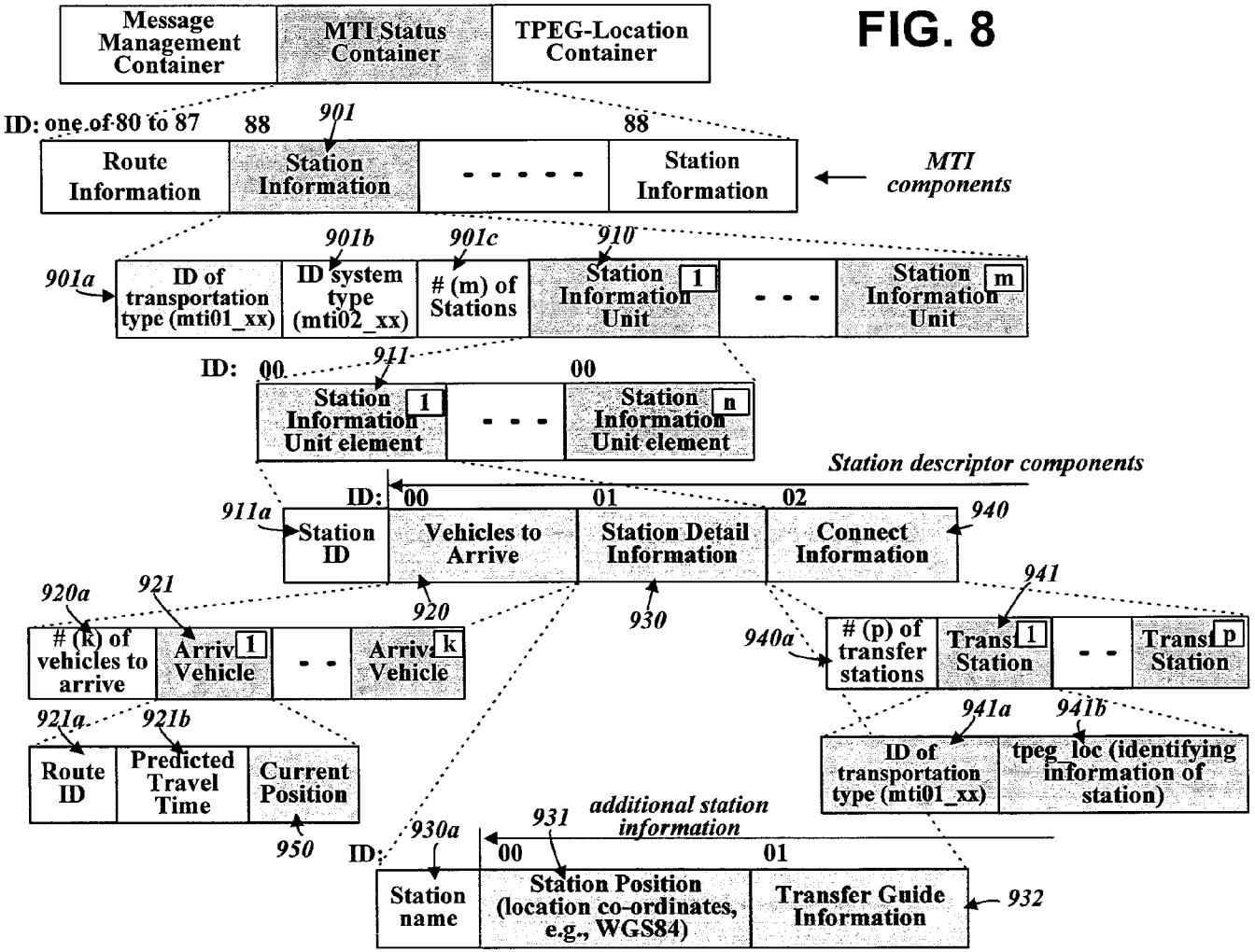
Figure 10A:
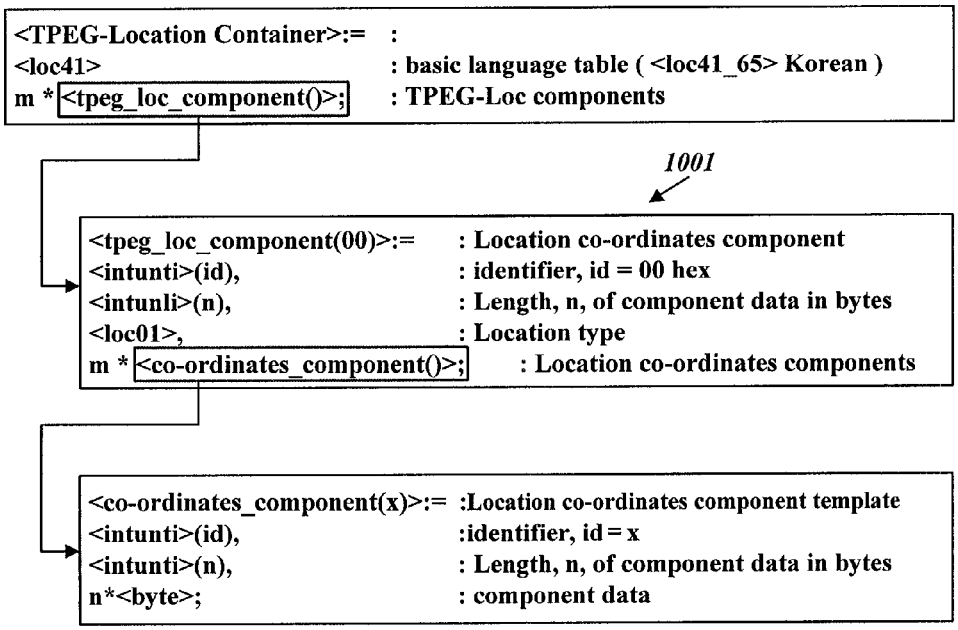
Figure 10B:
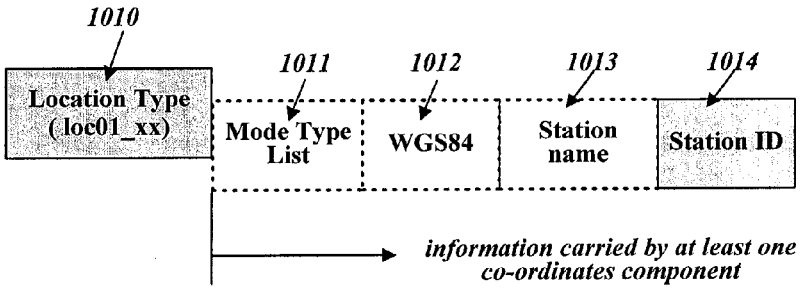
Figures 10C, 11:
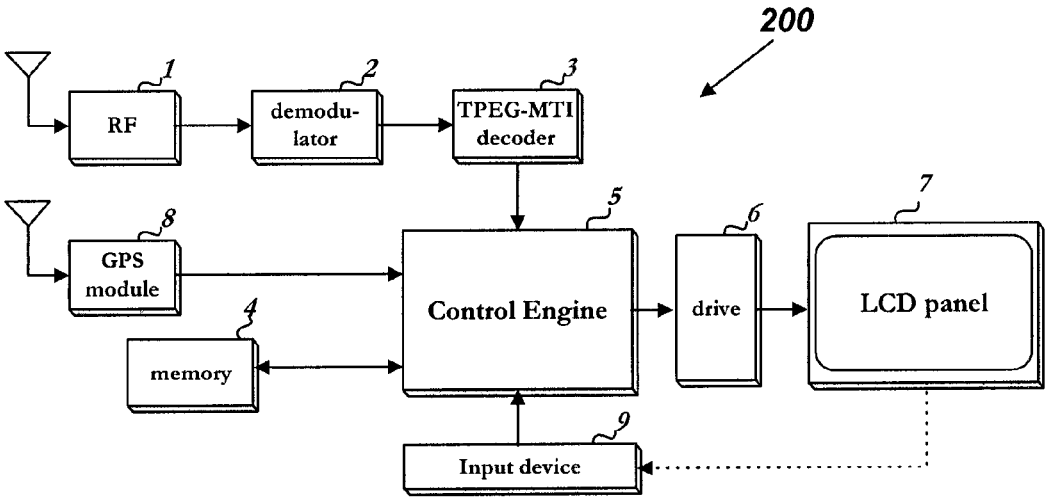
Figure 13:
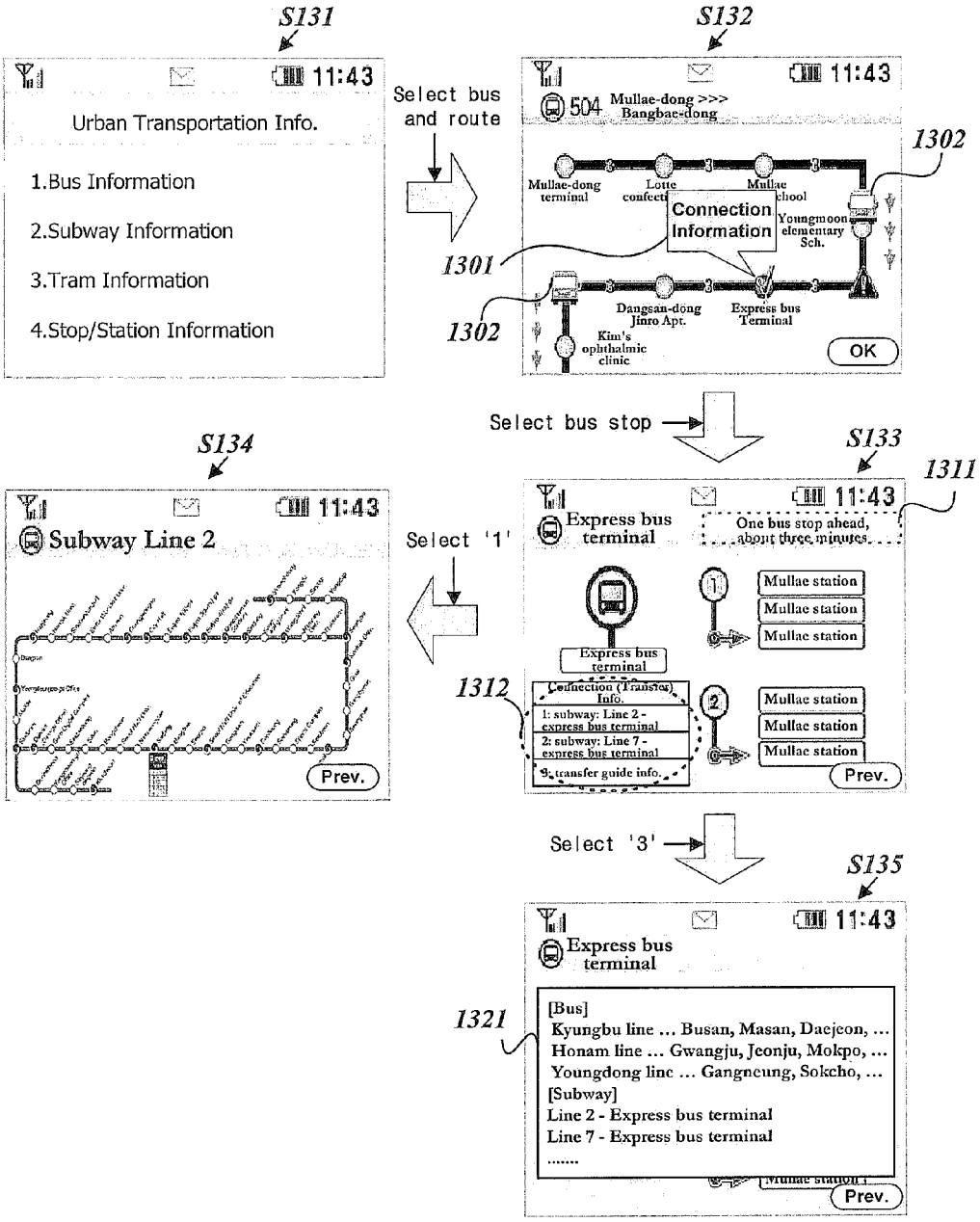

FIGS. 6A through 6H respectively illustrate syntax of an individual information element constituting the transfer format of FIG. 5;

FIGS. 7A and 7B respectively illustrate code tables defining types of public transportation means and a public transportation service information system according to one embodiment of the present invention;

FIG. 8 illustrates the transfer format of TPEG message of public transportation information organized according to another embodiment of the present invention with regard to an application status container;

FIGS. 9A through 9G respectively illustrate syntax of an individual information element constituting the transfer format of FIG. 8;

FIGS. 10A and 10B respectively illustrate syntax and a transfer format of a coordinates component carrying information of a connecting station, the component included in the transfer station unit of FIG. 9G and thus transferred;

FIG. 10C illustrates syntax of a component providing additional information in association with providing public transportation information according to one embodiment of the present invention;

FIG. 11 illustrates a block diagram of a navigation terminal that receives public transportation information transmitted from a transportation information server according to one embodiment of the present invention;

FIGS. 12A and 12B respectively illustrate how the terminal of FIG. 11 stores received public transportation information according to one embodiment of the present invention when the public transportation information is received according to the embodiment illustrated in FIG. 5 and/or FIG. 8;

FIG. 12C illustrates how the terminal of FIG. 11 stores received public transportation information according to another embodiment of the present invention when the public transportation information is received according to the embodiment illustrated in FIG. 5 and/or FIG. 8; and FIG. 13 illustrates a screen display of service route information and connection information of a station provided according to a request for public transportation information from the user.

5. BEST MODE FOR CARRYING OUT THE INVENTION

Hereinafter, according to the present invention, embodiments will be described in detail with reference to appended drawings.

Figure 1:
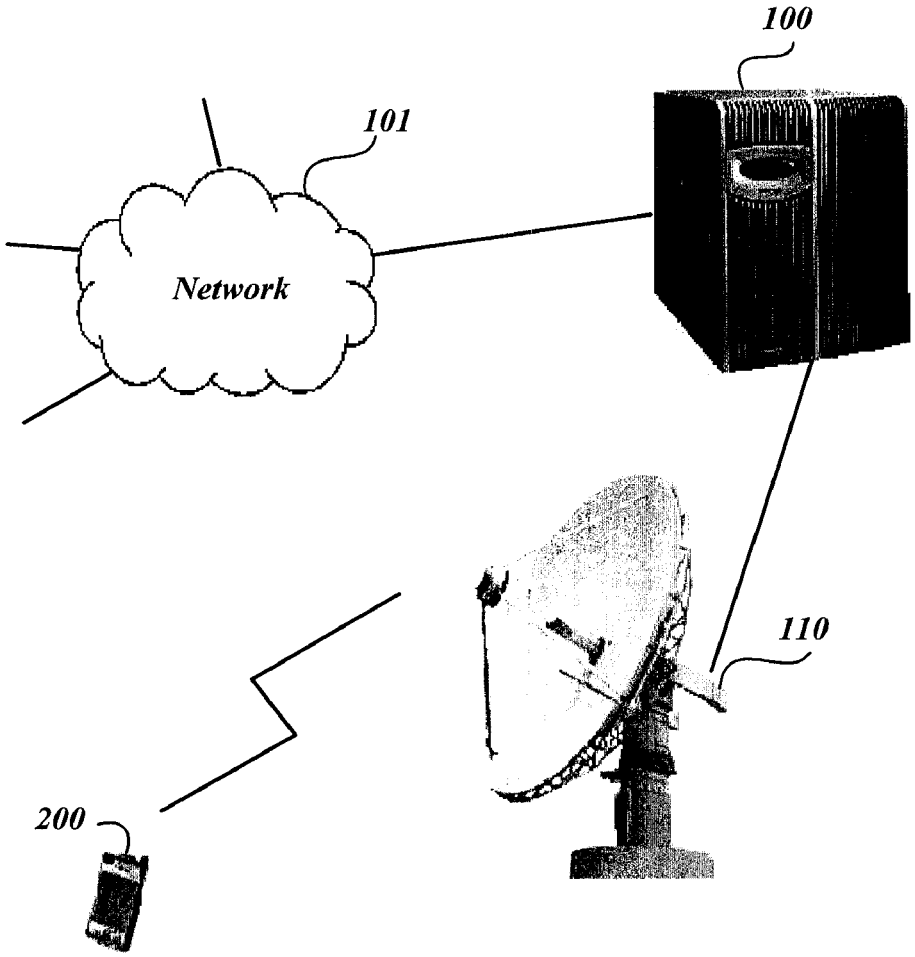
FIG. 1 illustrates a network providing public transportation information according to the present invention.

FIG. 1 illustrates a network providing service conditions information (hereinafter, it is called 'public transportation information') about various types of public transportation means, for example, a bus, a subway train, a tram, and other miscellaneous city transportation means (e.g., a sightseeing boat or a regularly run city sightseeing bus) according to the present invention. In the network of FIG. 1, a transportation information providing server 100 in a broadcast station reconfigures public transportation information collected from various sources (e.g., operator input and public transportation information received from another server through a network 101) and transmits the reconfigured information wirelessly through a wireless signal transmission apparatus 110 so that a public transportation information receiving terminal 200 (in the following, it is called as a 'terminal' for short) carried by an ordinary citizen can receive the information.

A public transportation means which is the object of public transportation information, for example, a bus, a train, or a ship transmits information of its location to the corresponding transportation information collection server (not shown) allocated for each transportation type through a separate wireless network (and a dedicated wired network) at a predetermined frequency. Each transportation information collecting server provides in realtime the transportation information providing server 100 with collected public transportation information of the corresponding type. It is transparent that a single integrated transportation information collecting server can collect transportation information about all kinds of public transportation means and the transportation information providing server 100 can take the role of an integrated transportation information collecting server.

Figure 2:
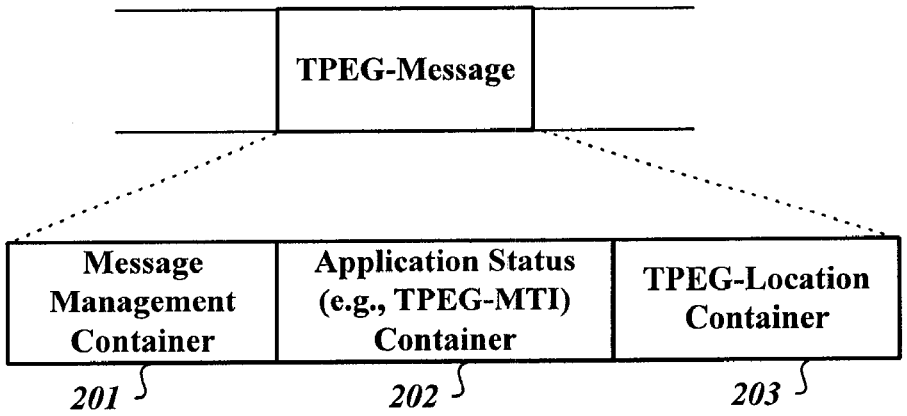
FIG. 2 illustrates a structure of TPEG message including public transportation information.

Public transportation information that is transmitted wirelessly from the transportation information providing server 100 is provided as a sequence of TPEG (Transport Protocol Experts Group) messages. As shown in FIG. 2, one TPEG message in the sequence comprises a message management container 201, an application status container 202, and a TPEG location container 203. In the embodiments according to the present invention, since the application status container 202 carries information about service routes and service hours of various types of public transportation means in a big city, it is alternatively called as a TPEG-MTI (Metropolitan Transportation Information) container rather than an application status container. Although the term of TPEG-MTI container' has been introduced to denote a container carrying public transportation information, such selection of a term has no relevance to the purpose of the present invention and a different but relevant term can be utilized, which equally applies to each message element in the following.

The transportation information providing server 100 analyzes collected public transportation information and according to the type of a transportation means, organizes service route-based information (e.g., location information about an individual transportation means belonging to a particular service route, a list of stops according to respective service routes, and the like) into a hierarchical structure of components according to predefined syntax. Also, the transportation information providing server 100, according to the type of a transportation means, organizes stop, station, or harbor-based information (e.g., information about transportation means to arrive at a particular stop, station, or harbor; predicted arrival time to the stop, station, or harbor; and the like) into a hierarchical structure of components according to predefined syntax, where the components are incorporated into an application status container 202. In what follows, the term of 'station' is used to indicate a place such as a stop, a station, or a harbor where one can use the corresponding transportation means.

The transportation information providing server 100 fills a message management container 201 with necessary information, thereby configuring a TPEG message. Also, as shown in FIG. 2, when location-related information is needed for a TPEG message, a TPEG location container 203 is prepared and incorporated in the TPEG message.

In the following, detailed introduction to the contents of public transportation information and a method for organizing the public transportation information are fully described.

The transportation information providing server 100, at the time of organizing the message management container 201, records information in the container 201 according to the syntax illustrated in FIG. 3. The information recorded in the message management container 201 includes message generation time 302 according to message ID, version of a provided service, and a selector 301. In addition thereto, current date and time information can be included. Two bytes (intunli: integer unsigned little) are allocated for a field 303 carrying information about data length, where length of subsequent data is recorded.

The application status container 202 and the TPEG location container 203 consist of more than one MTI component according to the syntax illustrated in FIG. 4, respectively. The selector 301 occupies one byte (intunti: integer unsigned tiny) of the message management container 201 and the most significant bit of the selector is set to '1' when component data for MTI follow next. As shown in FIG. 4, information about data size carried in each MTI component has a value expressed in two bytes (intunli).

As shown in FIG. 4, when the transportation information providing server 100 configures component data, an identifier of one byte indicating a component type is recorded in each component. In one embodiment according to the present invention, for the case of a component carrying service route-based transportation means information, the identifier takes a value from 0x80 to 0x87 according to the class of the component. For the case of a component carrying station-based transportation means information, a value of 0x88 is assigned to the identifier whereas 0xB0 is assigned for the case of a TPEG location container.

As described earlier, in order to configure a component of public transportation information according to the present invention, the transportation information providing server 100 can configure and provide service information of public transportation means in terms of a service route and/or stations.

First, described in detail is an embodiment where a component of public transportation information is configured based on service routes and thus provided. In what follows below, a notation of 'locNN_ii' (NN and ii represent a number) is introduced to represent a specific value. The notation of locNN_ii indicates ii value in the table specified by locNN among various loc tables (or hard-coded tables) stored already in the terminal 200, which is predefined between the transportation information providing server 100 and the terminal 200. mtiNN_ii used in a description or a figure differs from the above interpretation only in the fact that mti table is utilized, where mti table is another one predefined between the transportation information providing server 100 and the terminal 200. Although part of the values originated from a table defined by TPEG have been utilized in the embodiments according to the present invention, the present invention is not limited by particular standard specifications and an arbitrary table newly defined between public transportation information sources and a terminal can be equally utilized.

The transportation information providing server 100, according to a data transfer format illustrated in FIG. 5, incorporates a route information unit 501 (a set of MTI components, each of which has an identifier ranging from 0x80 to 0x87) into the application status container. (An MTI component of an identifier 0x88 (a station information unit) can be incorporated into the same application status container, for which it is described later.)

The route information unit 501 is a set comprising at least one from among a component (which is an MTI component of an identifier 0x80 and is called a 'transportation means location component using station sequential number' in the following) carrying information notifying of current locations of public transportation means (e.g., a bus, a subway train, a monorail, and a ship) running a particular service route (e.g., a bus, a subway, or a sea route) by using station sequential numbers, a component (which is an MTI component of an identifier 0x81 and is called a 'transportation means location component using station identifier' in the following) carrying information notifying of current locations of public transportation means running a service route by using station identifiers (IDs), a component (which is an MTI component of an identifier 0x82 and is called a 'transportation means location component using section identifier' in the following) carrying information notifying of current locations of public transportation means running a service route by using section identifiers, a component (which is an MTI component of an identifier 0x83 and is called a 'transportation means location component using section of station sequential number' in the following) carrying information notifying of current locations of public transportation means running a service route by using a section designated by station sequential numbers placed at the ends of the section, a component (which is an MTI component of an identifier 0x84 and is called a 'transportation means location component using section of station identifier' in the following) carrying information notifying of current locations of public transportation means running a service route by using a section designated by station identifiers placed at the ends of the section, a component (which is an MTI component of an identifier 0x85 and is called a 'section travel time component' in the following) carrying travel time for each section determined by stations constituting a service route, a component (which is an MTI component of an identifier 0x86 and is called a 'route additional information component' in the following) carrying additional information about a service route, and a component (which is an MTI component of an identifier 0x87 and is called a 'station list component' in the following) carrying identifying information about stations running a service route.

To explain more specifically about each individual MTI component introduced above, the transportation means location component using station sequential number organizes the information according to the syntax illustrated in FIG. 6A, comprising information indicating type of public transportation means running the service route (mti01_xx) 511, information for identifying a transportation means service information system (e.g., an identifying information allocation system for a station, a section, a service route, etc) (mti02_xx) 512, a service route identifier of four bytes (intunlo: integer unsigned long) designating a service route of the corresponding transportation route 513, the number of transportation means being in service on the corresponding service route 514, and as many service route fields using station sequential number 510 as the number of transportation means in service carrying station sequential numbers. Each service route field using station sequential number 601 configured according to the syntax of FIG. 6A contains a sequential number of a station where a transportation means is currently located or a sequential number of a station closest to the transportation means. A station sequential number is the one assigned to each station belonging to a service route of the corresponding transportation means along a service direction of the transportation means.

FIG. 7A illustrates types of transportation means indicated by individual values of the mti01_xx and FIG. 7B illustrates transportation means service information systems indicated by individual values of the mti02_xx.

In another embodiment according to the present invention, as shown in FIG. 6A, each service route field 601*a* using station sequential number carries a sequential number of a station where a transportation means is currently located or a sequential number of a station closest to the transportation means and predicted time for the transportation means to arrive at the next station as well. The predicted arrival time is expressed in units of a second by using two bytes (intunli).

The transportation means location component using station identifier organizes the information according to the syntax illustrated in FIG. 6B, including, in the same way as the transportation means location component using station sequential number, information indicating type of a transportation means running the service route (mti01_xx), information for identifying a transportation means service information system (mti02_xx), a four-byte (intunlo) long service route identifier specifying a service route, and the number of transportation means being in service on the corresponding service route. In order to notify of the current location of a transportation means by using a station identifier (ID) rather than a station sequential number, as many service route fields 520 using station identifier (ID) as the number of the transportation means in service are included. The service route field using station ID 602 configured according to the syntax of FIG. 6B records ID of a station where a transportation means is currently located or a station close to the current location thereof. A station ID, with respect to a type of public transportation means, is a station number or a code, or a combination of the both assigned uniquely to each of stations belonging to the entire service area of public transportation information. Since the station ID should be able to express stations more than station sequential number of one byte does, four bytes are used to express the ID. Therefore, between different types of public transportation means (e.g., between a bus and a subway train), the same station ID can be utilized.

In another embodiment according to the present invention, as shown in FIG. 6B, each service route field 602*a* using station ID carries an ID of a station where a transportation means is currently located or an ID of a station closest to the transportation means and predicted time for the transportation means to arrive at the next station as well. The predicted arrival time is expressed in units of a second by using two bytes.

The transportation means location component using section identifier, transportation means location component using section of station sequential number, and transportation means location component using section of station identifier also organize the information according to the syntax illustrated respectively in FIGS. 6C, 6D, and 6E, each of the components including information indicating type of a transportation means running the service route (mti01_xx), information for identifying a transportation means service information system (mti02_xx), a service route identifier identifying a particular service route, and the number of transportation means being in service on the corresponding service route. The transportation means location component using section identifier, transportation means location component using section of station sequential number, and transportation means location component using section of station identifier include in the order of appearance, a service route field using section identifier 530, 603 expressing a current location of a transportation means being in service by a section identifier of four bytes, a service route field using a pair of station sequential numbers 540, 604 expressing the location by a section designated by sequential numbers of both stations, and a service route field using a pair of station IDs 550, 605 expressing the location by a section designated by identifiers of both stations.

In another embodiment according to the present invention, a service route field using section identifier 603*a*, a service route field using a pair of station sequential numbers 604*a*, and a service route field using a pair of station IDs 605*a* contained respectively in the transportation means location component using section identifier, transportation means location component using section of station sequential number, and transportation means location component using section of station identifier, as shown in FIGS. 6C through 6E, carry predicted time for a transportation means at the corresponding location to arrive at the next station. The predicted time is also expressed in units of a second using two bytes as is done for the previous transportation means location component. Since the transportation means location component using section identifier, transportation means location component using section of station sequential number, and transportation means location component using section of station identifier express the location of a transportation means in service in terms of sections, predicted arrival time contained in a service route field using section identifier 603*a*, a service route field using a pair of station sequential numbers 604*a*, and a service route field using a pair of station IDs 605*a* corresponds to predicted time to arrive at a station which is the destination point of the section.

The transportation information providing server 100, with respect to a particular service route belonging to the type of a transportation means to be coded, determines a component of a class regarded as most appropriate for expressing location of a transportation means being in service and configures the component, thus providing the component for a terminal. For example, when the number of transportation means located in a section between stations is smaller than the number of transportation means stopped at stations on a service route in question, a transportation means location component using station sequential number is organized and provided for the terminal. This is intended to increase accuracy about locations of all the transportation means of the corresponding service route. The reason for not choosing a transportation means location component using station identifier is that since a station identifier has the corresponding field larger than that of station sequential number, it is necessary to reduce the amount of data transfer. However, when a sequential number about a station of the corresponding service route does not exist in the information agreed mutually with the terminal, a transportation means location component using station identifier is chosen. If the number of transportation means located in a section between stations is larger than the number of transportation means stopped at stations on a service route in question, to increase accuracy about locations of all the transportation means of provided information, a transportation means location component using section identifier, a transportation means location component using section of station sequential number, or a transportation means location component using section of station identifier is organized and provided for the terminal. In such a case, too, however, location of each transportation means can still be informed by a transportation means location component using station sequential number in order to reduce the amount of data transfer rather than increase accuracy of location.

The transportation information providing server 100, to transfer section travel time between stations with respect to a particular service route belonging to the type of a transportation means to be coded, configures a section travel time component (an MTI component of an identifier 0x85) according to the syntax illustrated in FIG. 6F, the component carrying information indicating type of public transportation means running the service route (mti01_xx), information for identifying a transportation means service information system (mti02_xx), a service route identifier designating the corresponding service route, the number of stations constituting the corresponding service route 561, and travel time of the transportation means for each individual section of the service route 560. The section travel time component does not make use of identifying information of each section but places travel time of the corresponding section according to the order of individual sections starting from a start point of the corresponding service route (namely, according to the order of stations). By not transferring identifying information about section, data size can be reduced. The station located at the initial start point is not counted in the number of stations 561. Therefore, the number of travel time fields carried by the travel time component is the same as the number of stations 561.

In another embodiment according to the present invention, the number of stations 561 covers all the stations including the initial start point of the corresponding service route. In the present invention, since the number of stations 561 is larger than the number of travel time fields contained in the section travel time component by one, a terminal receiving public transportation information decodes as many travel time fields as specified by the number of stations 561 minus one.

In order to transfer additional information about the service route of a transportation means, the transportation information providing server 100 organizes a route additional information component (an MTI component of an identifier 0x86) according to the syntax illustrated in FIG. 6G. The component includes information indicating type of a transportation means running the service route (mti01_xx), information for identifying a transportation means service information system (mti02_xx), a service route identifier designating the corresponding service route, a service name of the service route 571, and more than one additional service information 570.

The service name 571 is such information that when type of a transportation means is a bus, it is a number designating a bus service route such as no. 777 or that number with additional direction information such as no. 777 bound for 'Suweon' or no. 777 bound for 'Sadang'. A bus company name such as 'Daewon Express' can also be incorporated into the service name 571. When the type of a transportation means is a subway train, the service name 571 can be a number or a string identifying a subway route such as 'line 3', that with additional direction information such as line 3 bound for 'Suseo', or a combination of the both with a service company name such as 'city transit corporation'.

According to an identifier indicating type of contained information, type of a service route (e.g., for the case of a bus, the type can be one from among 'inter-city', 'main line', 'branch line' whereas it can be either 'circulation' or 'non-circulation' for the case of a subway), a service company name, operation start and end time of the corresponding service route, service interval, service charge, and a retrieval terminal of the service route can be included in the additional service information 570.

To transfer information about stations constituting a service route, the transportation information providing server 100 organizes a station list component (an MTI component of an identifier 0x87) according to the syntax illustrated in FIG. 6H, the component including information indicating type of a transportation means running the service route (mti01_xx), information for identifying a transportation means service information system (mti02_xx), a service route identifier designating the corresponding service, information consisting of one byte indicating the number of stations constituting the service route, and station IDs 580 as many as the number of stations. The station IDs are placed in the component according to the service order of the transportation means starting from a station corresponding to a start point of the service route.

The transportation information providing server 100 transfers a section travel time component, a route additional information component, or a station list component carrying static information (information showing no change for many hours, e.g., a list of stations and service hours of a service route) after transfer of a transportation means location component carrying dynamic information (information showing changes in a short span of time, e.g., location of a transportation means in service) at every N-th transfer of the transportation means location component or at a predetermined frequency (e.g., one day, one week, or one month) rather than transfer at each transfer of the transportation means location component.

In one embodiment according to the present invention, since a single component (a format selected from among components having formats of FIGS. 6A through 6E) is used for transferring current locations of transportation means belonging to a service route, if, in a big city where public transportation information is in service, the numbers of service routes according to the types of a transportation means being in service are P1, P2, . . . , Pk, respectively, location information about all the operating transportation means of service routes corresponding to all types of public transportation means in the big city can be provided for once by transferring S1 (=P1+P2+ . . . +Pk) transportation means location components.

In another embodiment according to the present invention, with respect to current locations of transportation means belonging to a service route, multiple classes can be used from among component classes (station sequential number, station identifier, section identifier, section of station sequential number, and section of station identifier) rather than a single class only. For example, if the number of transportation means running on a service route is N, a transportation means location component using station sequential number or station identifier is organized for n (n<N) transportation means currently stopped at a station and thus transferred whereas a transportation means location component using section identifier, section of station sequential number, or section station identifier is organized for 'N−n' transportation means currently running in a section and thus transferred. To realize the present embodiment, the syntax for configuration format of the component illustrated in FIGS. 6A through 6E, instead of a field for the number of transportation means in service or in addition to the field, includes a field for the number of transportation location information elements and records the number of subsequent location information elements (namely, station sequential number, station identifier, a pair of station sequential numbers designating a section, or a pair of station identifiers designating a section) in this field.

The transportation information providing server 100, as described earlier, configures each container and component according to the syntax having the structure illustrated in FIGS. 3, 4 and 6A through 6H and prepares a TPEG message containing the containers and components according to the transfer format illustrated in FIG. 5 and transmits the TPEG message to the terminal through the wireless signal transmission apparatus 110.

In what follows, described in detail is an embodiment where a component of public transportation information is organized based on stations and thus provided.

The transportation information providing server 100 loads a station information unit 901 (an MTI component of an identifier 0x88) complying with the syntax illustrated in FIG. 9A into the application status container according to the transfer format illustrated in FIG. 8. (A route information unit described above can be configured and loaded into the same application status container and the specific method for configuration has been described earlier.) The station information unit 901 includes information (mti01_xx) 901*a* indicating type of a transportation means running the corresponding service route assigned respectively according to FIGS. 7A and 7B, information for identifying a transportation means service information system (mti02_xx) 901*b*, the number of stations 901*c*, and as many station information units 910 as the number of the stations.

The transportation information providing server 100 loads static information (e.g., location information of each station) and dynamic information (e.g., information of transportation means to arrive at each station) of all the stations with respect to all the types of transportation means belonging to a service area of current public transportation information into the single station information unit 901 (an MTI component of an identifier 0x88) and thus transfers the information.

In another embodiment according to the present invention, all the stations are classified into several groups in terms of a particular criterion and by assigning one station information unit 901 to each group and thus transferring multiple station information units, public transportation information about all the stations within information service area can be transferred.

The individual station information unit 910 includes more than one station information unit element 911. A bus station information unit element 911 of an identifier 0x00 is created in regard to the corresponding station according to the syntax illustrated in FIG. 9B, including an ID 911*a* of a station to which loaded information is applied and multiple station descriptor components. The station descriptor component, according to each individual identifier, transfers information of transportation means to arrive (Vehicle To Arrive), station detail information, and connection information about stations linked to the same or a different type of a transportation means.

An information unit for transportation means to arrive 920 (a station descriptor component of an identifier 0x00) which is a component transferring information of transportation means to arrive organizes the information according to the syntax illustrated in FIG. 9C, including information 920*a* about the number of transportation means to arrive at the corresponding station and an arrival transportation means unit 921 carrying information about each transportation means to arrive. In one embodiment according to the present invention, the arrival transportation means unit 921 is created with one-to-one correspondence to service routes of transportation means to arrive at a station designated by station ID 910A. In other words, among transportation means to arrive belonging to a particular service route, a single arrival transportation means unit 921 is created only for a transportation means closest to the designated station. In another embodiment according to the present invention, with respect to a service route, multiple arrival transportation means units 921 (e.g., three arrival transportation means units) can be created in the order of proximity of transportation means to the station.

The arrival transportation means unit 921 is transferred by including an ID 921*a* about a service route to which the corresponding transportation means belong, predicted travel time 921*b* for the transportation means to arrive, and information unit 950 about the current location of the transportation means to arrive. The information unit 950 about the current location of a transportation means to arrive, as shown in FIG. 9C, includes a selector 950*a* indicating type of subsequent information and according to the value of the selector, includes one from among station information composed according to the format 601 of service route field using station sequential number (route_information_using_station_sequential_number) of FIG. 6A, station information composed according to the format 602 of service route field using station identifier (route_information_using_station_id) of FIG. 6B, section information composed according to the format 603 of service route field using section identifier (route_information_using_section_id) of FIG. 6C, station information composed according to the format 604 of service route field using section of station sequential number (route_information_using_section_of station_sequential- _number) of FIG. 6D, and section information composed according to the format 605 of service route field using section of station identifier (route_information_using_section_of station_id) of FIG. 6E.

As an example of showing current location of a transportation means to arrive, when a transportation means is currently stopped at a station, a station sequential number of a station ID is transferred and displayed (selector 950*a*=01H or 02H). When a transportation means is currently running between stations, either the ID of the section is transferred and displayed (selector=04H) or a pair of sequential numbers or IDs (selector=08H or 10H) about start and end station of the section when an ID is not assigned to the section. Even if a section ID has been assigned, when stations constituting both ends of the section have sequential numbers, selector is assigned 08H and a pair of station sequential numbers is transferred in order to reduce transfer data size (from four bytes to two bytes).

A station detail information unit 930 (a station descriptor component of an identifier 0x01) comprising a component or a set of components transferring station detail information organizes the information according to the syntax illustrated in FIG. 9D and includes a station name 930*a* and more than one station additional information unit. The station additional information unit can include a station position unit 931 and a transfer guide information unit 932 along with an identifier indicating the type of contained information. The station position unit 931 organizes the information according to the syntax illustrated in FIG. 9E and includes coordinate information about a station (longitude and latitude). Coordinate information is coded after WGS84 or TM system, for example. Information about transportation means for transfer at the corresponding station and descriptor information about a station are contained in the transfer guide information unit 932, the size of the information not exceeding 65535 bytes (long_string defines a character string within the size of 65535 bytes). The transfer guide information unit 932 is included in a station information unit element 911 when a current station to be coded (a station designated by the station ID 911*a*) is located within such a close distance that the user can walk to a station where the same or a different type of a transportation means is available, namely when the current station is a transfer station; specific information about a transfer station is coded in another station descriptor component as connection information. When a different type of a transportation means available for transfer at a bus stop with a name of 'express bus terminal' is a subway train, for example, the transfer guide information unit 932 can include descriptions of each entrance and exit of the corresponding subway station and information about service direction of the subway train. The transfer guide information can also include description about destinations of a transportation means in service such as long distance transportation means available at the bus stop (e.g., an express bus). The transfer guide information unit 932 can also include transfer guide information about the same type of a transportation means in addition to transfer guide information about a different type of a transportation means. For example, when a current station to be coded is a subway station and the station is connected to another station providing a different service route, information about transfer direction to reach the station can be included.

A connection information unit 940 (a station descriptor component of an identifier 0x02) which is a component transferring connection information about transfer stations organizes the information according to the syntax illustrated in FIG. 9G and includes information 940*a* about the number of stations of the same or a different type of a transportation means available for transfer from the current corresponding station and as many transfer station units 941 carrying information about each individual transfer station as the number of the stations 940*a*. The transfer station unit 921 includes type of a transportation means running to and from the corresponding station 941*a* and a station identification unit 941*b* carrying information for identifying the station.

The station identification unit 941*b* corresponds to tpeg_loc_component 1001 of an identifier 00 having a hierarchical structure illustrated in FIG. 10A and information about location of a station is included in the component according to the structure illustrated in FIG. 10B. As shown in the figure, the station identification unit 941*b* includes location type information 1010 having a value (loc01_xx) indicating type of a station (e.g., a bus stop, a subway station, a harbor, and so on) and a station ID 1014. The station identification unit 941*b* can selectively include a mode type list 1011, longitude and altitude coordinates of a station 1012, or a station name 1013. In another embodiment according to the present invention, instead of using the station identifier, a service route identifier of a transportation means running to and from the station and a station sequential number assigned to the station on the service route are included in the station identification unit 941*b* as information for identifying a transfer station.

Not only in the present embodiment but also in an embodiment of a service route-based public transportation information provision described above, the transportation information providing server 100 can provide additional information in association with operation of public transportation means for the terminal by using an MTI component configured according to the syntax illustrated in FIG. 10C. The MTI component at this moment has an identifier of 0x89 for example and transfers information in the form of a text within the size of 65535 bytes (long_string defines a character string within the size of 65535 bytes). Therefore, information specifying a language describing a text (loc41_xx) is included. Also a code specifying a country belonging to a service area (loc40_yy) is included; each individual value defined in an information organization system table illustrated in FIG. 8B is interpreted differently according to a country code and/or language code specified in the above code (loc40_yy). That is to say, FIG. 8B represents an mti02 table when the country code is 'Korea' and the language code is 'Korean'. If a different country code and language code are specified, a different table from the one illustrated in FIG. 8B is chosen and used for coding and decoding of public transportation information.

The transportation information providing server 100, as described earlier, configures each container and component according to the syntax having the structure illustrated in FIGS. 3, 4, 9A through 9G and 10A and 10B and prepares a TPEG message containing the containers and components according to the transfer format illustrated in FIG. 58 and transmits the TPEG message to the terminal through the wireless signal transmission apparatus 110.

In one embodiment according to the present invention, one station information unit (an MTI component with an organization format of FIG. 9A) organizes and transfers arrival information of a transportation means about all the stations that belong to a service route of one type of a transportation means. Therefore, if the number of types of transportation means running in a large area providing current public transportation information (e.g., in a metropolitan city) is j and the number of stations according to each type is Q1, Q2, . . . Qj, j station information units (an MTI component of an identifier 0x88) are transferred and since Q1, Q2, . . . Qj station information unit elements are included in respective station information units, arrival information about all the operating transportation means to arrive at stations of all the transportation types in the metropolitan city is provided for once.

In another embodiment according to the present invention, with respect to the transportation means of the same type, stations corresponding to the type can be divided into several groups; a station information unit is then organized for each group and arrival information about transportation means to arrive at the stations of the corresponding group can be provided.

The terminal 200 of FIG. 1 receiving public transportation signals transferred being encoded according to the embodiment described above can store basic information based on station ID and basic information based on service route ID in addition to the table described above such as mti and loc table. The basic information based on station ID can include a station type, a station name, and station longitude and latitude coordinates in association with the station ID; the basic information based on service route ID can include a service route name, a service route type, station IDs of a start and the last stop, the number of stations, operation start and end time for each station, and service route feature information in association with the service route ID. Service route feature information includes feature points capable of revealing the shape of a road when the road is displayed at VGA or QVGA resolution and ID and longitude and latitude coordinates of each feature point. For the case of a terminal equipped with basic information, when static information about service routes and stations provided as in the previous embodiment overlaps with the basic information embedded in the terminal, static information is used with high priority to the basic information and is provided for the user in case of need.

FIG. 11 is a detailed block diagram of a transportation information receiving terminal 200 of FIG. 1 that receives public transportation information transmitted from the transportation information providing server 100 in accordance with one embodiment of the invention. The terminal 200 of FIG. 11 comprises a tuner 1 resonating at the required frequency band of received public transportation information signals and subsequently outputting modulated public transportation information signals, a demodulator 2 outputting public transportation information signals by demodulating the modulated public transportation information signals, a TPEG-MTI decoder 3 decoding the demodulated public transportation information signals and acquiring public transportation information, a GPS module 8 for calculating a current position (i.e., latitude, longitude, and altitude) by receiving signals from a plurality of satellites, memory 4 storing decoded public transportation information, an input device 9 receiving the user's input, a control engine 5 controlling screen display based on the user's input, current location, and acquired public transportation information, an LCD panel 7 for video display and an LCD drive 6 feeding driving signals to the LCD panel 7 according to characters or graphic data for display. The input device 9 can be a touch screen equipped on the LCD panel 7. The terminal 200 can be further equipped with non-volatile memory containing an electronic map in addition to the memory 4.

The tuner 1 resonates at signals that the wireless signal transmission apparatus 110 transmits; the demodulator 2 demodulates and outputs resonating signals in a predetermined way. The TPEG-MTI decoder 3 then extracts from input demodulation signals data frames and from each data frame, extracts a public transportation information message which is transmitted with the structure according to FIGS. 2 through 5, FIGS. 6A through 6H and FIG. 10C and/or FIGS. 2 through 4, FIG. 8, FIGS. 9A through 9G, and FIGS. 10A through 10C and stores the public transportation information message temporarily. The TPEG-MTI decoder 3 then interprets the temporarily stored individual TPEG MTI message and delivers to the control engine 5 necessary information and/or control data according to the contents of the message. The TPEG-MTI decoder 3, when interpreting information contained in an MTI message, first checks the value (mti02_xx) for identifying a transportation means service information system carried by an MTI component (when an additional information component of FIG. 10C is provided, a table (namely, mti02 table) to be used for specifying a public transportation service information system based on country code and/or language code contained in the component is first specified and the value of 'xx' is confirmed in the specified table) and identifies a public transportation service information system specified by the checked value, e.g., an identifying number system of stations and service routes, from a list illustrated in FIG. 8B and interprets information contained in the component according thereto.

The TPEG-MTI decoder 3 determines decodability of public transportation information based on information (e.g., version information) in a message management container of each extracted TPEG MTI message and decodes subsequent data according to selector information. When message creation time is included in a message management container, the time information is provided from the corresponding message for the control engine 5 along with decoding information. The creation time is used for the control engine 5 to determine whether to use decoded dynamic information. For example, if current time is different from the creation time of decoded dynamic information by a predefined amount of time, the decoded information is deleted.

The control engine 5, when data received from the TPEG-MTI decoder 3 are information based on service routes, that is to say, information decoded from MTI components of identifier 0x80 through 0x87, by using the information organizes a service route-based information table having the structure of FIG. 12A in the memory 4. At this point, the service route-based information table is so prepared that the contents thereof are grouped according to transportation types. FIG. 12A specifically illustrates service route-based information when type of a transportation means is a bus. When the data received from the TPEG-MTI decoder 3 is station-based information, namely information decoded from an MTI component of 0x88, the control engine 5 organizes a station-based information table in the memory 4 by utilizing the structure of FIG. 12B. In this case, also, the station-based information table is prepared in such a way that the contents thereof are grouped according to transportation types. FIG. 12B specifically illustrates station-based information when type of a transportation means is a bus. FIGS. 12A and 12B are only examples of data storage structure and decoded information elements not shown in the storage table illustrated in FIGS. 12A and 12B (e.g., a service route type, a service company name of a transportation means, start and end time of a transportation service, service charge, and coordinate information of stations) can be further included. Also, a different structure from FIGS. 12A and 12B, e.g., decoded information in an integrated form according to the type of a transportation means as shown in FIG. 12C can be stored.

Although specific names have been used as identification information for each station (and transfer station) in the examples of FIGS. 12A and 12B, it is only intended to help understanding; in practice, an identifier assigned to each station (station ID) is used to store identification information. When the identifier is to be displayed for the user, a station name associated with the corresponding ID is read and used, the station name being received from basic information read out from separate memory or from a transportation information providing server 100.

In the information table illustrated in FIG. 12A, the section travel time column 1201 of each service route is the information built by decoding section travel time information transferred by the section travel time component of FIG. 5 (an MTI component of an identifier 0x85) and relating each section (each arrival station) sequentially from the start point of a service route in the order of travel time information disposed in a component; the current location information column 1202 of a transportation means of each service route is the one built by the information decoded from a transportation means location component of FIG. 5 (an MTI component of an identifier chosen from 0x80 to 0x84).

According to another embodiment of the present invention, if the transportation means location component described above includes predicted travel time for respective transportation means to arrive at destination stations, the predicted arrival time is also extracted and can be built into the table illustrated in FIG. 12A as a separate column. As a matter of course, the information constructed as above can be used for a transportation means of a service route selected by the user to calculate time to arrive at a selected station.

Meanwhile, in the information column 1202, 1 (which corresponds to yes) is the value set up when it is decoded that a transportation means is located at the corresponding station whereas 2 (which corresponds to a preceding section) is the value set up when it is decoded that a transportation means is located in a section where the station is a destination position. In other words, the example of FIG. 12A illustrates the case that when an identifier for a section where a starting position is 'Migeum station' and a destination position is 'Korea telecom' (or a pair of station (bus stop) sequential numbers or a pair of station (bus stop) IDs of 'Migeum station' and 'Korea Telecom') has been received as location information of a current transportation means (a bus in service), a value of 2 is assigned to the station (a bus stop) of 'Korea Telecom'.

In the information table illustrated in FIG. 12B, the column 1211 of predicted arrival time of a transportation means for each service route is the information built by adding current time to the predicted travel time 921*b* obtained by decoding information transferred by the arrival transportation means unit 921 of FIG. 8 (time difference value can be stored directly according to another embodiment of the present invention); the column 1212 of current location information of transportation means to arrive at each station is the one built by the information decoded from an information unit 950 about current location of FIG. 8. In the information column 1212, 0 or 1 is an indicator representing the case where decoded current location is expressed by a station sequential number or a station identifier, respectively; 2 is an indicator representing the case where decoded current location is expressed by a section identifier; 3 and 4 are indicators representing the cases expressed by a pair of station sequential numbers and a pair of station identifiers, respectively. As a matter of course, in the corresponding column 1212, a decoded station identifier (station ID or station sequential number) or a section identifier (section specification information given by a section ID, a pair of station sequential numbers or a pair of station IDs) is stored together in addition to the indicator.

In the information table illustrated in FIG. 12B, two columns 1213 containing type of a transportation means about a transfer station and identifying information of the station are the information built by decoding information transferred by a connection information unit 940 of FIG. 8 and the column 1214 of guide information about transfer stations is the information built by being decoded from the transfer guide information unit 932 of FIG. 8

Public transportation information stored with a structure such as shown in FIG. 12A, 12B or 12C updates the corresponding information every time new information is received from the transportation information providing server 100.

The control engine 5, with respect to dynamic information, can select and store only the data close to a current location identified by the GPS module 8, e.g., only the data about stations within a radius of 1 km rather than store all the data received from the TPEG-MTI decoder 3 in the memory 4. The above is intended to effectively utilize memory of limited capacity by selectively storing public transportation information expected to be most needed for the user carrying the terminal 200. As a matter of course, in this case, too, static information is all received and stored.

When the user requests 'public transportation information' through the input device 9 while received public transportation information is stored as described above, as shown in FIG. 13, a public transportation information related menu that the user can choose is displayed S131 on the LCD panel 7. If the user chooses one type of public transportation means from a displayed menu, an input window is provided and through the input window, a service route identifier or a station identifier about the transportation means of a chosen type is allowed to be entered. For the convenience of description below, it is assumed that the user has chosen a bus as public transportation means and a particular service route of a bus has been chosen.

If a particular service route of a bus is chosen, the control engine 5 searches the memory 4 and obtains from a table entry where the type of a transportation means is a bus, information of each bus stop with respect to the corresponding service route stored as in FIG. 12A, thereby displaying station (bus stop) names on a screen along with a service route ID and service route information as illustrated in FIG. 13 S132. At this point, as for a service route ID, an additional operation of symbols or text needed to enhance recognition speed of the user can be carried out. For example, when a transportation type is a bus and a service route ID is 'B504', by placing a character sting of 'main line[ ]' at a relevant position, it is displayed as 'main line[B]504 '. Similarly, G is displayed to denote 'branch line' and R is displayed to denote 'inter-city'.

For displaying station names on a screen, the order of stations of the corresponding transportation means service route follows a recording order in the pre-stored basic information about the corresponding transportation means service route or a placement order in the identifier list carried by received and decoded station list component (an MTI component of an identifier 0x87) described above.

The control engine 5, when displaying service route information on a screen, reads out section travel time about sections between individual stations from the corresponding column 1201 of the information table entry of FIG. 12A and displays the time on a station section area of a screen. At this moment, the control engine 5 searches the transfer station information table entry 1210 of FIG. 12B for each station belonging to a currently chosen service route. If an identical ID is found in a transfer station item column 1215, namely if an arbitrary station is the one having connection information, a special mark 1301 is added to the station (bus stop) to denote that the station is connected to a station where the same or a different type of a transportation means is available.

Also, at the request of the user or simultaneously with display of station names S132, by reading out Information about current location of a transportation means belonging to the corresponding service route from current location column 1202 of the information table entry of FIG. 12A and displaying the information at the corresponding position of a screen by using a particular mark 1302, the user can be informed of current location of a transportation means belonging to a chosen service route. If current location of a transportation means in service is specified by a section (e.g., '2' (pre-section)), the particular mark 1302 is displayed in the middle of a section on a screen corresponding to the section (the section where a station designated by '2' becomes a destination station).

If the user selects a station (a bus stop) on a service route displayed on a screen by properly manipulating move keys equipped in the input device 9, the control engine 5 searches a station-based information table entry of FIG. 12B for various information received with respect to the station (e.g., predicted arrival time 1311 and information about each service route that passes through the bus stop) and displays the searched information on a screen. If the selected station has connection information (namely, if the identifier of the selected station is also recorded in a transfer station item column 1215 of a transfer station information table entry 1210), a 'connection information (transfer information) menu' 1312 composed based on the connection information is also displayed S133. While displaying a 'connection information menu', a transportation type about the corresponding transfer station and the station name are displayed and an item to select 'transfer guide information' is also displayed. According to an embodiment of the present invention, although an identifier of a transfer station is received and stored in the connection information, the control engine 5 searches a station-based information table entry of the corresponding transportation type for the corresponding station identifier based on a transportation type and a station identifier within connection information and displays a name stored in association with the identifier or a name stored in basic information on the 'connection information menu' 1312.

If the user selects one item on a 'connection information menu' 1312, the control engine 5 looks for a transportation type corresponding to the item and service route information of the corresponding transportation type to which the station belongs in a service route-based information table entry about the transportation type (a subway train in the example of FIG. 13) and displays station names on a screen as illustrated in FIG. 13 together with a service route ID and service route information S134. A service route-based information table entry of the corresponding transportation type composed as in FIG. 12A is searched for a service route ID including a station identifier identical to a station identifier of a selected connection information item and information about a station stored individually in association with the service route ID (an identifier and a name) and thus necessary service route information is obtained.

If the user selects 'transfer guide information' on the connection information menu 1312, the control engine 5 extracts transfer guide information stored in association with an identifier identical to the identifier of the selected station and contained in a transfer guide information column 1214 of a transfer station information table entry 1210 and displays the information on a screen S135. The transfer guide information 1321 displayed as above includes not only information about a station of a different type of a transportation means transferable from a currently selected station but also service information of a long distance transportation means available (an express bus, an airplane, or a train) when the user getting off at the selected station. As a matter of course, such information is the one coded and transferred from the transportation information providing server 100.

If the user requests a search for a station on a public transportation information related menu S131, the control engine 5 additionally requests a transportation type. If a transportation type is selected, the control engine 5 searches the memory 4 for stations of a selected transportation type, positions of which are expressed by longitude and latitude coordinates (information obtained from basic information or a station position unit 931 of FIG. 8) and are within a predefined distance (e.g., 1 km) from current positions identified by the GPS module 8 and displays the names thereof as a list on the LCD panel 7. In another embodiment according to the present invention, by arranging all the station names stored with respect to a selected transportation type in alphabetical order, a station can be selected according to the user's request.

If the user selects a station on a displayed list through the input device 9, the control engine 5, with respect to the station, obtains information about predicted arrival time about each service route passing through the station from an predicted arrival time column 1211 of a station-based information table entry of the corresponding transportation type stored in the memory 4 as illustrated in FIG. 12B and displays predicted waiting time on a screen together with identification information of each service route. If the selected station has connection information, too, a 'connection information menu' 1312 is displayed in the same manner as described above; with respect to a selected item on a connection information menu, additional information according to the selection, i.e., service route information of a different transportation type or transfer guide information is displayed S134 or S135.

By the input of another selection key or a move key through the input device 9, different information stored with respect to an individual service route of the corresponding station, e.g., information about current location of a transportation means supposed to arrive can also be read out from a transportation means current location column 1212 of a station-based information table entry of FIG. 12B and displayed.

If the terminal 200 is equipped with volatile memory (hereinafter, it is called a 'storage means') containing an electronic map and a station is selected while the previous station list is displayed, necessary part of an electronic map (an area that can be displayed on the LCD panel 7) centering around the position of the station can be read out from the storage means and displayed on the LCD panel 7 through the drive 6. At this time, a special graphic symbol is displayed at the place corresponding to a current position and also for the position where a selected station is located, description information of the station and a special graphic symbol are displayed.

As for additional information of various types of transportation means received from the transportation information providing server 100 and being stored in addition to provision of information described in detail above, e.g., type of a transportation means service route, a service company name, start and end time of a service, service interval, service charge, and a retrieval terminal of the service route, it is obviously understood that if the user selects the additional information by using a menu selection method provided in an appropriate way, selected information from among the various additional information can be provided for the user by displaying the selected information.

On the other hand, in the embodiments described above, the terminal of FIG. 11 can be equipped with a voice output means. In this case, if the user selects a station and a particular service route from among service routes that pass through the station, predicted arrival time is output in a voice; if a service route and a station belonging to the service route are selected, information about transfer at the station and a station or a section where a transportation means of the service route is currently located can be output in a voice. In addition thereto, different information can also be output in a voice. The voice output means is equipped beforehand with data necessary for voice synthesis.

The foregoing description of a preferred embodiment of the present invention has been presented for purposes of illustration. Thus, those skilled in the art may utilize the invention and various embodiments with improvements, modifications, substitutions, or additions within the spirit and scope of the invention as defined by the following appended claims.

The invention claimed is:

1. A method for processing public transportation information, comprising:

encoding the public transportation information, wherein the public transportation information includes information about type of transportation means, service route identifying information of the type of transportation means, information about current locations of transportation means in service belonging to the service route identifying information of the type of transportation means, and connection information for a particular station among a plurality of stations; and transmitting encoded public transportation information, wherein the connection information comprises an identifier for type of transportation means, which is available at another station, and information for identifying the another station.

2. The method of claim 1, wherein the information about a current location is information that identifies a station or a section between stations where transportation means is currently located.

3. The method of claim 2, wherein the information identifying a station is either a number or an identifier, the number being one of numbers that are assigned sequentially to stations belonging to an arbitrary service route of the type of transportation means, and the identifier being one of identifiers that are assigned to individual stations to uniquely identify a single station among all of stations belonging to the type of transportation means within a service area of the public transportation information.

4. The method of claim 2, wherein the information identifying a section is either an identifier, a pair of numbers, or a pair of identifiers, the identifier being one of identifiers that are assigned to individual sections to uniquely identify a single section from all of sections belonging to the type of transportation means a service area of the public transportation information, the numbers being ones selected from numbers that are assigned sequentially to stations belonging to an arbitrary service route of the type of transportation means, the pair of identifiers being selected from identifiers that are assigned to individual stations to uniquely identify a single station among all of stations belonging to the type of transportation means within a service area of the public transportation information.

5. The method of claim 1, wherein the public transportation information further includes an information system identifier for identifying information system of a service by the transportation means.

6. A method for processing public transportation information, comprising:

encoding the public transportation information including information about a type of transportation means, identifying information about individual stations belonging to a service route of the type of transportation means, and connection information for a particular station among the individual stations, the particular station being adjacent to another station where same or different type of transportation means is available; and transmitting encoded public transportation information, wherein the connection information comprises an identifier for type of transportation means, which is available at the another station, and information for identifying the another station.

7. The method of claim 6, wherein the information for identifying the another station includes an identifier that is one among identifiers that are assigned to individual stations for uniquely identifying a single station from among all stations belonging to a service route of transportation means belonging to a type of transportation means available at the another station.

8. The method of claim 6, wherein the information for identifying the another station includes service route information of transportation means available at the another station and a number assigned to the another station from numbers that are assigned sequentially to stations belonging to a service route identified by the service route information.

9. The method of claim 6, wherein the public transportation information further includes a transfer guide information for a station where a different type of transportation means is available at a nearby place.

10. The method of claim 6, wherein the public transportation information further includes an information system identifier for identifying information system of a service by the transportation means.

11. The method of claim 6, wherein the public transportation information further includes, for each of the individual stations, a number of transportation means to arrive at the each station and as much information about transportation means to arrive as the number.

12. The method of claim 11, wherein the information about transportation means to arrive includes at least one from among service route information of transportation means to arrive, predicted arrival time of the transportation means and current location information of the transportation means.

13. A method for processing public transportation information, the method comprising:

receiving the public transportation information including information about a type of transportation means, a service route identifying information of the type of transportation means, information about current locations of transportation means in service belonging to a service route identified by the service route identifying information, and connection information for a particular station among a plurality of stations; and decoding the received public transportation information, wherein the connection information comprises an identifier for the type of transportation means, which is available at another station, and information for identifying the another station.

14. The method of claim 13, wherein the information about current location is information that identifies a station or a section between stations where transportation means is currently located.

15. The method of claim 14, wherein the information identifying a station is either a number or an identifier, the number being one of numbers that are assigned sequentially to stations belonging to an arbitrary service route of the type of transportation means, and the identifier being one of identifiers that are assigned to individual stations to uniquely identify a single station among all of stations belonging to the type of transportation means within a service area of the public transportation information.

16. The method of claim 14, wherein the information identifying a section is either an identifier, a pair of numbers, or a pair of identifiers, the identifier being one of identifiers that are assigned to individual sections to uniquely identify a single section from all of sections belonging to the type of transportation means a service area of the public transportation information, the numbers being ones selected from numbers that are assigned sequentially to stations belonging to an arbitrary service route of the type of transportation means, the pair of identifiers being selected from identifiers that are assigned to individual stations to uniquely identify a single station among all of stations belonging to the type of transportation means within a service area of the public transportation information.

17. The method of claim 13, wherein the public transportation information further includes an information system identifier for identifying information system of a service by transportation means.

18. A method for decoding public transportation information, comprising:

extracting status information from received signals; and extracting from the extracted status information type information of public transportation means, identifying information about stations belonging to a service route of the type of transportation means, and for at least one station among the stations, connection information including information of another station where same or different type of public transportation means is available.

19. The method of claim 18, wherein the at least one station is one adjacent to the another station.

20. The method of claim 18, wherein the connection information includes an identifier for type of transportation means, which is available at the another station, and information for identifying the another station.

21. The method of claim 20, wherein the information for identifying the another station includes an identifier that is one among identifiers that are assigned to individual stations for uniquely identifying a single station from among all stations belonging to a service route of transportation means belonging to a type of transportation means available at the another station.

22. The method of claim 20, wherein the information for identifying the another station includes service route information of transportation means available at the another station and a number assigned to the another station from numbers that are assigned sequentially to stations belonging to a service route identified by the service route information.

23. The method of claim 18, wherein the extracting from the extracted status information further extracts, for at least one station from among the stations, information for guiding transfer to a different type of transportation means from the status information.

24. The method of claim 18, wherein the extracting from the extracted status information further extracts from the status information an information system identifier for identifying information system of a service by the transportation means.

25. The method of claim 18, wherein the extracting from the extracted status information further extracts from the status information, for each of the stations, number of transportation means to arrive at the each station and as much information about transportation means to arrive as the number.

26. The method of claim 25, wherein the information about transportation means to arrive includes at least one from among service route information of transportation means to arrive, predicted arrival time of the transportation means and current location information of the transportation means.

27. An apparatus for decoding public transportation information, comprising:

a demodulator configured for demodulating received signals to output a message sequence carrying public transportation information;

a decoder configured for extracting status information from each message of the message sequence, and extracting from the status information type information of public transportation means, service route identifying information of the type of transportation means, and information about current locations of transportation means in service belonging to a service route of the transportation means, or extracting from the status information type information of public transportation means, identifying information about stations belonging to a service route of the type of transportation means, and for at least one station among the stations, connection information including information of another station where same or different type of public transportation means is available; and a controller configured for storing the extracted information in storage means and outputting the stored information or part thereof through an output unit according to a given condition.

28. The apparatus of claim 27, wherein the connection information includes an identifier for type of transportation means, which is available at the another station, and information for identifying the another station.

29. The apparatus of claim 28, wherein the information for identifying the another station includes an identifier that is one among identifiers that are assigned to individual stations for uniquely identifying a single station from among all stations belonging to a service route of transportation means belonging to a type of transportation means available at the another station.

30. The apparatus of claim 28, wherein the information for identifying the another station includes service route information of transportation means available at the another station and a number assigned to the another station from numbers that are assigned sequentially to stations belonging to a service route identified by the service route information.

31. The apparatus of claim 27, further comprising a location detector configured for detecting information about a current location, wherein the controller is configured to store in the storage means static information of the extracted information and to store in the storage means only such dynamic information that is related to stations close to the detected current location.

32. The apparatus of claim 27, wherein if information about a selected station includes connection information, the controller outputs through the output unit, based on the connection information, menu information informing transportation means to transfer to and/or a station of the transportation means.

33. The apparatus of claim 32, wherein if an item is selected from the menu information, the controller outputs through the output unit service route information of transportation means whose service route includes a station corresponding to the selected item.

34. The apparatus of claim 27, wherein the output unit is configured to present the stored information or part thereof visually or audibly.

* * * * *